US008621732B2

(12) United States Patent
Heitmann et al.

(10) Patent No.: US 8,621,732 B2
(45) Date of Patent: Jan. 7, 2014

(54) RAPPER DEVICE

(75) Inventors: Alfons Heitmann, Gummerbach (DE); Thomas Paul Von Kossak-Glowczewski, Gummersbach (DE)

(73) Assignee: Shell Oil Company, Houston, TX (US)

( * ) Notice: Subject to any disclaimer, the term of this patent is extended or adjusted under 35 U.S.C. 154(b) by 1034 days.

(21) Appl. No.: 12/628,964

(22) Filed: Dec. 1, 2009

(65) Prior Publication Data

US 2010/0139890 A1 Jun. 10, 2010

Related U.S. Application Data

(60) Provisional application No. 61/120,078, filed on Dec. 5, 2008.

(30) Foreign Application Priority Data

Dec. 2, 2008 (EP) ..... 08170456

(51) Int. Cl.

| | |
|---|---|
| ***B21C 43/00*** | (2006.01) |
| ***F28G 7/00*** | (2006.01) |
| ***B08B 7/02*** | (2006.01) |
| ***B08B 9/00*** | (2006.01) |
| ***B08B 7/00*** | (2006.01) |

(52) U.S. Cl.

USPC ..... 29/81.15; 29/890.031; 29/81.01; 29/81.02; 29/81.021; 134/16; 165/84; 165/95; 15/89; 15/91; 15/92; 15/104.07; 15/246.5

(58) Field of Classification Search

USPC ..... 29/890.031, 81.01, 81.15, DIG. 53, 29/81.02, 81.021; 134/16, 8; 165/84; 15/89, 91, 92, 104.07, 246.5

See application file for complete search history.

(56) References Cited

U.S. PATENT DOCUMENTS

| | | | | | |
|---|---|---|---|---|---|
| 2,777,535 | A | * | 1/1957 | Hull | 96/36 |
| 2,985,802 | A | * | 5/1961 | Drenning | 96/36 |
| 3,477,124 | A | * | 11/1969 | Reed et al. | 29/592.1 |
| 3,626,770 | A | | 12/1971 | Lindberg et al. | 74/18.2 |
| 4,120,672 | A | * | 10/1978 | Lanese | 96/36 |
| 4,372,268 | A | * | 2/1983 | Kolarik | 123/383 |
| 4,409,007 | A | * | 10/1983 | Torrey et al. | 96/36 |
| 4,457,361 | A | * | 7/1984 | Premel et al. | 165/84 |
| 4,595,048 | A | * | 6/1986 | Pollak et al. | 165/84 |

(Continued)

FOREIGN PATENT DOCUMENTS

| | | | |
|---|---|---|---|
| DE | 3127734 | 7/1984 | 165/84 |
| GB | 2104614 | 3/1983 | B08B 9/00 |
| GB | 2147078 | 5/1985 | B25D 1/00 |
| JP | 2002220593 | 8/2002 | F28G 7/00 |

*Primary Examiner* — David Bryant
*Assistant Examiner* — Jun Yoo

(57) ABSTRACT

A method and a rapper device for cleaning a heat exchange surface in a pressure vessel. The rapper device includes a striker rod which has one end contacting the heat exchange surface in the pressure vessel and one end projecting out of the pressure vessel via a passage opening. The rapper device also includes an impacting device for impacting the projecting end of the striker rod. A section of the striker rod is slideably supported in a pressure chamber adjacent the passage opening. The pressure chamber is connected to a sealing gas supply maintaining the pressure in the pressure chamber at a higher level than the pressure in the pressure vessel. A bellows defines a pressure chamber around at least a section of the striker rod.

8 Claims, 1 Drawing Sheet

(56) References Cited

U.S. PATENT DOCUMENTS 5,079,459 A * 1/1992 Huston et al. ..... 310/15
5,597,417 A 1/1997 Thones et al. ..... 134/1
5,765,510 A * 6/1998 Krowech et al. ..... 122/379
8,291,560 B2 * 10/2012 Peippo ..... 29/81.15

* cited by examiner

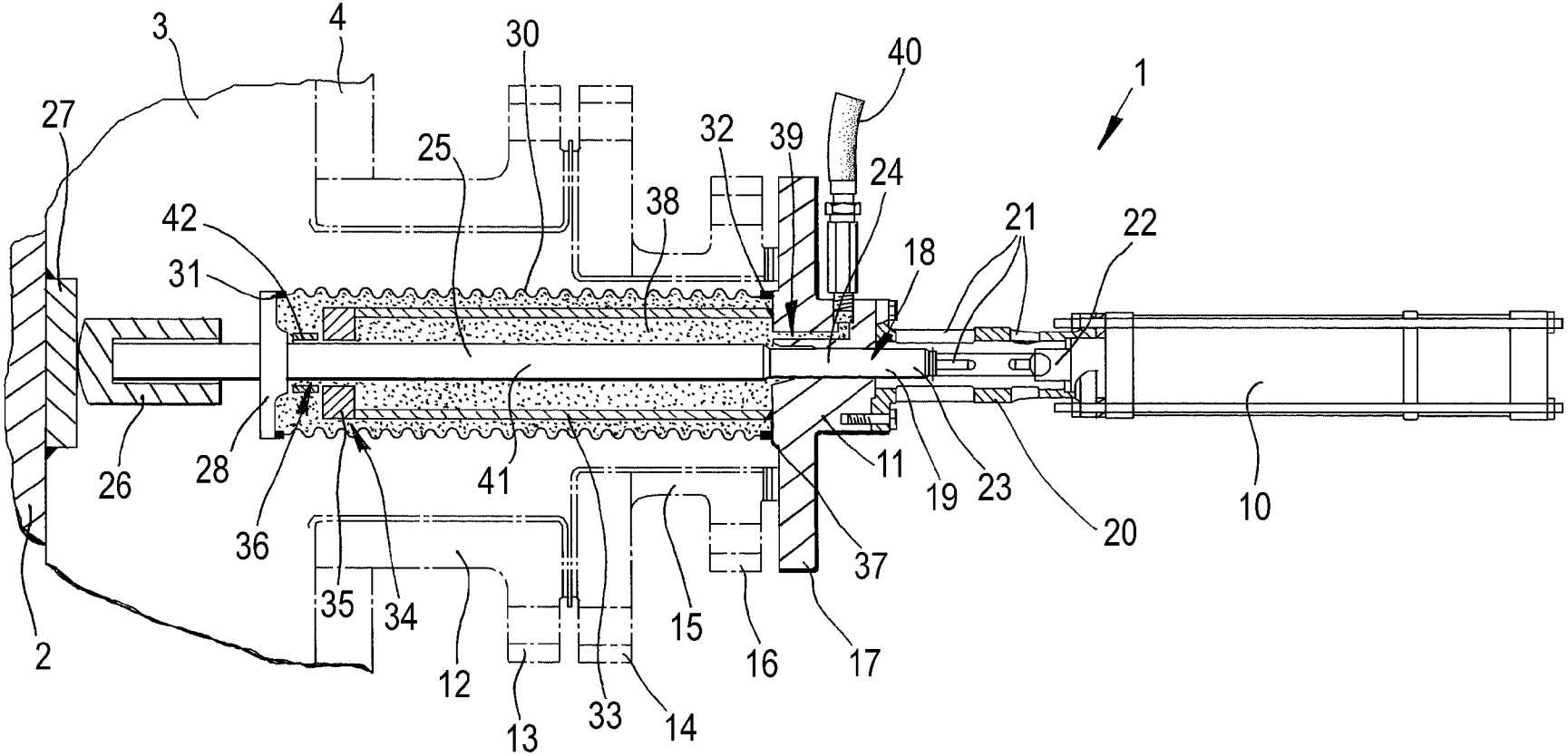
1
10
22
20
21
23
19
18
11
40
24
37
17
39
16
32
15
38
14
33
30
13
41
12
25
34
4
35
36
42
31
28
3
26
27
2

RAPPER DEVICE

This application claims the benefit of European Application No. 08170456.1 filed Dec. 2, 2008 and U.S. Provisional Application No. 61/120,078 filed Dec. 5, 2008, both of which are incorporated by reference.

BACKGROUND OF THE INVENTION

The present invention relates to a rapper device for cleaning heat exchange surfaces in a pressure vessel for transporting hot dust-laden gas.

Hot process gases can contain fouling components, such as fine dust and molten or evaporated components, which turn sticky when they cool and condense, thereby adhering to each other and to surfaces in contact with the gases. These fouling components can form harmful deposits, particularly on heat exchange surfaces.

Such hot process gases can for example be synthetic gases synthesized by partial combustion processes, generally referred to as syngas. These gases are guided along heat exchanging surfaces in a pressure vessel.

Fouling deposits from hot dust laden process gases can be removed by using a rapper device, such as the rapper device disclosed in British patent application GB 2 104 614 A. This prior art rapper device comprises an energy transmitting element having one end within a pressure vessel contacting the heat exchange surface to be cleaned, and one end outside the pressure vessel, which is repetitively knocked by an impact device. The impact energy of the knocking device is passed through the energy transmitting element to the heat exchange surface. The heat exchange surface and the deposits adhering thereto are accelerated differently by the transmitted impact energy as a result of different mass moments of inertia. As a result, the deposits fall off the heating surface.

The pressure within the pressure vessel is much higher than the atmospheric environmental pressure outside the pressure vessel. For example, in coal pressure gasification plants the pressure in the heat exchange vessel can be as high as about 40 bar. Due to these differences in pressure, the energy transmitting element is forced towards the outside of the pressure vessel. In GB 2 104 614 A, a gas pressure equalizing device is used to overcome this force. Since the pressure on the one end of the energy transmitting element should be equal to the pressure exerted on the end abutting the heat exchange surface, the surface area of the energy transmitting element within the pressure chamber should be sufficiently high. Since in GB 2 104 614 A the wall of the pressure vessel is interrupted where it is passed by the energy transmitting element, a number of seals must be used to prevent leakage of synthetic gas, which is toxic and inflammable. These seals typically have short life cycles.

U.S. Pat. No. 5,597,417 describes a method and apparatus for the percussive cleaning of objects disposed in a chamber that is under process pressure, wherein it is provided that for a more simple pressure balancing that at least during the acceleration of the striker, the two ends of the striker be maintained at the same pressure, which essentially corresponds to the pressure in the process chamber.

SUMMARY OF THE INVENTION

The present invention provides a rapping method and device wherein leakage of synthetic gas from the pressure vessel is effectively reduced, while the pressure exerted on the energy transmitting element in the pressure vessel is balanced.

Embodiments of the invention comprise a method and apparatus for cleaning a heat exchange surface in a pressure vessel by transmitting impact energy from a rapper device comprising a striker rod that has one end contacting the heat exchange surface in the pressure vessel and one end projecting out of the pressure vessel via a passage opening, wherein the rapper device comprises an impacting device for impacting the projecting end of the striker rod, and wherein a section of the striker rod is slideably supported in a pressure chamber adjacent the passage opening, and wherein the pressure chamber is connected to a sealing gas supply maintaining the pressure in the pressure chamber at a higher level than the pressure in the pressure vessel.

BRIEF DESCRIPTION OF THE DRAWING

FIG. 1 is a cross-sectional view of one embodiment of a rapping device according to the invention.

DETAILED DESCRIPTION

The pressure in the pressure chamber can, e.g., be maintained at about at least 10% higher than the pressure in the pressure vessel. While the pressure in the pressure vessel is typically about 40 bar, the pressure in the pressure chamber can for example be kept about 6-7 bar higher. With such overpressures, additional springs to bias the striker rod against the heat exchange surface are not required anymore.

Suitable gases are for instance inert gases, such as nitrogen or carbon dioxide.

In one embodiment, the invention comprises a rapper device for cleaning a heat exchange surface in a pressure vessel by transmitting impact energy. The rapper device comprises a striker rod and an impacting device for impacting the striker rod that has one end contacting the heat exchange surface in the pressure vessel and one end projecting out of the pressure vessel via a passage opening into a pressure chamber, which is connected to a gas pressure source. A bellows defines a gastight chamber around at least a part of the striker rod in the pressure chamber with a gastight connection to a wall section surrounding the passage opening. This way, a sealing gas can be supplied under an overpressure without contaminating the process gases with the used sealing gas. No sealing gas is consumed. Instead of a continuous flow of sealing gas, there is only a pressurized sealing gas chamber. This has the advantage that there is no risk of dew point corrosion and no pre-heating of the sealing gas is required anymore to prevent dew point corrosion. Also, the supply line can be small sized.

The bellows can for example be made of a foldable steel foil, aluminum foil or any other suitable heat and pressure resistant flexible material. The bellows may comprise a tubular corrugated concertina structure of adjustable axial length, the concertina structure having pleats with folds between axially adjacent pleats acting as hinges.

The striker rod can be provided with a flange positioned within the pressure vessel, while the bellows is connected to the flange in a gastight manner.

Optionally, the part of the striker rod within the bellows is slideably supported by a support member with one end connected to a wall section around the passage opening within the gastight chamber defined by the bellows.

To ensure a minimum distance between the support member and the flange on the striker rod, a spacer can be used. The spacer can for example be ring shaped, coaxially surrounding the striker rod. In case of low sealing gas pressure, the striker rod will be moved in the direction towards the outside of the pressure vessel. The spacer limits the movement and thus avoids damage of the expansion bellows.

Optionally, the passage opening is a central opening in a flange connected to the wall of the pressure vessel. This flange can for example be connected to a flanged bus branching off from the pressure vessel. The flanged bus can for example be connected to a flanged bus of a larger diameter connected to the wall of the pressure vessel.

The present invention will be elucidated with reference to the drawing wherein FIG. 1 shows in cross section a rapping device according to the present invention.

FIG. 1 shows in cross section a rapper device 1 for cleaning a heat exchange surface 2 in a pressure vessel 3 with a pressure vessel wall 4. In the pressure vessel 3, synthetic gas, synthesized, e.g., by partial combustion of oil or coal, is guided along the heat exchange surface 2, e.g., of a heat exchange pipe, which is cooled by a flowing cooling medium, such as water. The rapper device 1 comprises an impact device 10 attached to a housing 11 on the wall of the pressure vessel 3. The housing 11 comprises a first flanged bus 12 of a larger diameter branching off from the pressure vessel wall 4. The bus 12 comprises a flange 13 connected to a flange 14 welded to a second flanged bus 15 of a smaller diameter having an end flange 16 which is connected to a top flange 17 defining a passage opening 18 for a striker rod 19. In line with the passage opening 18 is a spacer 20 with openings 21. The spacer 20 can for instance be cylindrical. The spacer 20 carries the impact device 10 having a knocker head 22 in line with the striker rod 19 and opposite a free end 23 of the striker rod 19.

In an alternative embodiment, the rapper device according to the present invention can be built with a single flanged bus 12, without flange 14 and bus 15 with flange 16. Other configurations can also be used within the frame of the present invention, if so desired.

The free end 23 of the striker rod 19 is part of a section 24 passing the passage opening 18. A second section 25 of the striker rod 19 has a larger diameter than the passage opening 18 and extends in the direction of the heat exchange surface 2. Near the heat exchange surface 2, the striker rod 19 is provided with a head 26 of an enlarged diameter. The head 26 can for example be connected to the second section 25 of the strike rod 19 by means of a screw thread connection. The head 26 engages an anvil plate 27 welded onto the heat exchange surface 2. Due to the enlarged diameter of the head 26, the contact surface between the head 26 and the anvil plate 27 is enlarged. The head 26 is made of a material of lower mechanical strength than the material used for section 25 and anvil plate 27. As a result, the replaceable head 26 will deform more than the other parts during operation of the rapper device 1. After a certain period of use, the deformed head 26 can be be exchanged for a new head 26.

A coaxial circular flange 28 is gastight connected to the second section 25 of the striker rod 19. A tubular bellows 30, which can, e.g., be made of a steel foil has a first end 31 connected to the perimeter of the circular flange 28. The connection between the flange 28 and the first end 31 of the bellows 30 is gastight, e.g., a welded connection. The opposite second end 32 of the tubular bellows 31 is gastight connected to the top flange 17, in an area surrounding the passage opening 18.

Within the bellows 30 is a cylindrical support member 33 coaxially arranged with the striker rod 19. The cylindrical support member 33 has a first end 34 closed with an end wall 35 with a central opening 36 for the striker rod 19 which is slideably supported within the central opening 36. The opposite second end 37 of the cylindrical support member 33 is gastight connected to the top flange 17 in the ring shaped area between the outer end 32 of the bellows 30 and the passage opening 18.

The bellows 30 defines a pressure chamber 38 in open connection to a sealing gas supply channel 39 which is operatively connected to a sealing gas supply 40. The pressure chamber 38 encases a central section 41 of the striker rod 19.

Bus 12 and flange 13 preferably have a larger diameter than necessary to accommodate bellows 30. Housing 11 is preferably assembled as follows. First, the axis of flange 13 relative to anvil plate 27 is measured. The hole in flange 14 is machined according to measurements to make sure that after assembly the axis of striker rod 19 is in the center of anvil plate 27. Also, the distance from anvil plate 27 to flange 13 may vary depending upon manufacturing deviations of pressure vessel 4 and heat exchange surface 2 from one rapper device 1 to another. Therefore, the length of cylindrical bus 15 may not be constant from one rapper device to the other. However, it is advantageous to have a striker rod 19 of a constant length, because machining striker rods of differing lengths for multiple rapper devices is difficult and expensive. To solve this problem, the length of cylindrical bus 15 may be machined according to the measured distance from flange 13 to anvil plate 27. Then, cylindrical bus 15 will be welded on flange 14 and the vertical, horizontal and radial orientation of rapper device 1 will be perfect.

In use, hot dust laden gas, e.g., syngas from a gasification reactor, passes through the space between the heat exchange surface 2 and the pressure vessel wall 4. Fouling deposits are formed on the surface of the heat exchange wall 2. To clean this wall 2, the impact device 10 is actuated to knock with its knocker head 22 with a certain impact force onto the first section of the striker rod 19. The striker rod 19 passes the impact via its enlarged head 26 and the anvil plate 27 to the heat exchange wall 2. The shock load loosens the fouling which falls off of the wall 2. Due to the impact forces, the striker rod 19 will become shorter after long time operation. The length of the striker rod 19 can be monitored via the openings 21. If the striker rod 19 is not visible anymore via these openings 21, the striker rod 19 needs to be replaced. Optionally, the opening 21 can be provided with a scale to monitor progress of the size reduction of striker rod 19 in detail.

To prevent leakage of hot, inflammable and toxic syngas through the passage opening 18, an inert sealing gas is blown into the pressure chamber 38 defined by the bellows 30. The pressure within the pressure vessel 3 is substantial higher than atmospheric. As a result, a force is exerted on the striker rod 19 to push it out of the pressure vessel 3 via the passage opening 18. Since the pressure within the pressure vessel can be as high as, for instance, 40 bar, the launching force on the striker rod can be very high. To overcome this force, the sealing gas is supplied to the pressure chamber under overpressure, to produce a counterforce on the striker rod 19 and the flange 28. The overpressure can be such that the head 26 of the striker rod 19 is firmly pressed against the anvil plate 27 of the heat exchange wall 2. The pressure in the pressure chamber 38 can, e.g., be about 6-7 bar higher than the pressure of about 40 bar in the pressure vessel 3. The bellows 30 with its gastight connections to the flange 28 and the flange 17 prevents contamination of the syngas by the used sealing gas. Since the wall of the gastight chamber is defined by a bellows 30, the striker rod 19 still has the required freedom of movement in its axial direction. When the pressure in the pressure chamber 38 drops, a spacer 42 maintains a distance between the flange 28 and the end wall 35 of the support member 30 to limit movement of the striker rod 19 in the direction towards the outside of the pressure vessel and to avoid damage of the bellows 30.

That which is claimed is:

1. A rapper device for cleaning a heat exchange surface in a pressure vessel by transmitting impact energy, the rapper device comprising:

a striker rod which has a head contacting the heat exchange surface in the pressure vessel and one end projecting out of the pressure vessel via a passage opening; and an impacting device for impacting the striker rod;

wherein a bellows defines a pressure chamber around at least a section of the striker rod, the pressure chamber having a gastight connection to a wall section surrounding the passage opening.

2. A rapper device according to claim 1 wherein the bellows is made of a foldable steel foil.

3. A rapper device according to claim 1 wherein striker rod is provided with a flange positioned within the pressure vessel and wherein the bellows is connected to the flange in a gastight manner.

4. A rapper device according to claim 3 wherein the part of the striker rod within the bellows is slideably supported by a support member with one end connected to a wall section around the passage opening within the pressure chamber defined by the bellows.

5. A rapper device according to claim 4 wherein a spacer is positioned between the support member and the flange on the striker rod.

6. A rapper device according to claim 1 wherein the passage opening is a central opening in a flange connected to a wall of the pressure vessel.

7. A rapper device according to claim 6 wherein the flange is connected to a flanged bus to accommodate the bellows, the flanged bus extending outwardly from the pressure vessel.

8. A rapper device according to claim 1, wherein the rapper device is positioned relative to the pressure vessel wall by measuring the distance from a flange to an anvil plate, machining the hole in the flange according to measurements to make sure that after assembly an axis of the striker rod is in a center of the anvil plate, then machining a length of a cylindrical bus according to the measured distance from the flange to the anvil plate.

* * * * *